US007819247B2

(12) United States Patent
Gonzalez

(10) Patent No.: US 7,819,247 B2
(45) Date of Patent: Oct. 26, 2010

(54) COMBINED LAPTOP CASE AND LAPTOP STAND

(76) Inventor: Pedro Felipe Gonzalez, 7204 19th Ave., NW., Bradenton, FL (US) 34209

( * ) Notice: Subject to any disclaimer, the term of this patent is extended or adjusted under 35 U.S.C. 154(b) by 0 days.

(21) Appl. No.: 12/380,947

(22) Filed: Mar. 4, 2009

(65) Prior Publication Data

US 2010/0224532 A1 Sep. 9, 2010

(51) Int. Cl.

| | |
|---|---|
| ***B65D 85/00*** | (2006.01) |
| ***B65D 5/52*** | (2006.01) |
| ***A45C 5/14*** | (2006.01) |
| ***A47B 3/10*** | (2006.01) |
| ***H05K 5/00*** | (2006.01) |

(52) U.S. Cl. ..... 206/320; 190/11; 190/18 A; 206/756; 206/764; 361/679.01

(58) Field of Classification Search ..... 206/320, 206/576, 751, 756, 759, 762, 764; 190/11, 190/18 R, 18 A; 108/36; 361/679.01, 683, 361/687

See application file for complete search history.

(56) References Cited

U.S. PATENT DOCUMENTS

| | | | | |
|---|---|---|---|---|
| 1,332,605 | A * | 3/1920 | Child | 16/42 T |
| 3,163,034 | A * | 12/1964 | George | 70/419 |
| 4,856,627 | A * | 8/1989 | Polatov | 190/11 |
| 5,090,562 | A * | 2/1992 | Grullemans | 206/320 |
| 5,400,903 | A * | 3/1995 | Cooley | 206/320 |
| 6,036,011 | A * | 3/2000 | DeCurtis et al. | 206/320 |
| 6,311,944 | B1 * | 11/2001 | McKsymick et al. | 108/36 |
| 6,578,708 | B2 * | 6/2003 | Barnett | 206/320 |
| 7,327,562 | B2 * | 2/2008 | Littlepage | 190/11 |
| D598,671 | S * | 8/2009 | Gagnon, Jr. | D6/430 |
| 7,672,117 | B1 * | 3/2010 | Gary et al. | 206/320 |
| 7,775,356 | B2 * | 8/2010 | Palmer | 206/320 |
| 2002/0063072 | A1 * | 5/2002 | Pham | 206/320 |
| 2008/0099638 | A1 * | 5/2008 | Diener et al. | 248/176.3 |
| 2008/0253081 | A1 * | 10/2008 | Tracy et al. | 361/687 |

* cited by examiner

*Primary Examiner*—Bryon P Gehman
(74) *Attorney, Agent, or Firm*—Albert Bordas, P.A.

(57) ABSTRACT

The present invention is a multifunction carrying case that is capable of carrying a laptop computer and converting into a laptop stand. The height of the laptop stand is telescoping, allowing for use in different situations. The case-stand combination comprises a housing similar to a hard-sided briefcase. The bottom compartment of the housing comprises a platform with a stand assembly beneath it. The stand assembly comprises a top base, telescoping risers and a bottom base. Until deployed, the bottom base is contiguous with the exterior surface of the bottom compartment. When deployed, the stand assembly is a "Z"-type shape to counterbalance the weight of the housing and a laptop computer.

20 Claims, 9 Drawing Sheets

COMBINED LAPTOP CASE AND LAPTOP STAND

BACKGROUND OF THE INVENTION

1. Technical Field of the Invention

This invention relates generally to carrying cases for laptops and stands for laptops. More specifically, it relates to a carrying case capable of housing both a laptop and a collapsible laptop stand.

2. Background of the Invention

Laptops

Computers first became portable by combining the computer, monitor and keyboard into a single unit. The first portable computers were created in the late 1970's. None of these early prototypes were ever marketed to the public. The first portable computers did not become commercially available until seven years later, in 1983. Early laptops were not convenient to transport because of their size and weight. It was not until the late 1980's that laptops were lightweight and compact enough to be convenient to transport. Since that time, laptops have become more lightweight and their components have become smaller, allowing for skinnier and smaller transport devices' designs.

Laptop Stands

The portability of laptops has led to the advent of tables and stands for laptops, allowing the user to set up a work area for their laptop virtually anywhere. Laptop-sized stands are widely available in a number of designs. These small stands are designed to tilt the laptop forward, allowing for more ergonomic use of the laptop. Placing a laptop at the appropriate angle on a stand can minimize the neck and back fatigue. Another important and desirable feature of many laptop stands is their ability to dissipate the heat that builds up between a laptop and the surface on which it rests. Small laptop stands have been designed for use directly on the user's lap, on a table, and on other surfaces.

Larger laptop stands minimally comprise a surface on which to place a laptop and a base or legs that rest on the floor. Many of these stands are similar in design to tables that can be used while in a bed, a recliner or on a couch. Others are more compact and resemble portable versions of desktop computer stands. Most of the larger laptop stands also comprise wheels to aid in transportability. The major drawbacks to most of these designs are that they are designed for household use and their portability is limited. Most laptop stands are not nearly as portable as the laptops they are designed to hold. Another trend in laptop stands are fixed stands that are mounted into vehicles for ease of use by passengers while commuting or traveling.

Laptop Cases

As laptops have become increasingly lightweight, their portability has increased dramatically, which has led to the advent of the laptop case. The primary purpose of the laptop case is to carry a laptop, which increases its portability. The two important secondary purposes are to protect the laptop from damage and to provide security from theft. Laptop cases vary greatly in how well they succeed in those secondary purposes.

Laptop cases typically are padded to reduce bumps, scratches and drops to the laptop while it is being transported. Most laptop cases are also manufactured from water resistant or waterproof materials and are design to hold the laptop somewhat isolated from the surrounding environment. Laptop cases vary dramatically in size and storage space. Some cases only have room for the laptop itself. Most cases at a minimum have storage capacity for the laptop's power cable. Larger cases have room for a substantial array of accessories and documents, thus serving the dual role of laptop case and briefcase.

A laptop case commonly comprises a case for holding the laptop and a carrying means, which is generally a shoulder strap and/or a handle. The past few years have seen an explosion in the types of laptop carrying devices which have become commercially available. The two common styles of laptop bags are shoulder bags and backpack-style bags. The options include simple laptop sleeves, backpacks, totes, messenger bags and briefcases. The materials are normally leather, cloth, aluminum, nylon, polypropylene and other polymers.

Novelty laptop bags have established a marketing niche and set themselves apart from the more common types of laptop bags. The minimalist version of a laptop carrying device on the market is not a bag at all. It is a looped shoulder strap that is used to carry a laptop. A length of the strap is placed above the keyboard of an open laptop, so that when the laptop is closed, the laptop can be carried by the strap. The strap is marketed as a fast way to take a laptop through airport security.

Another unusual laptop case design is a cardboard laptop case made from a pizza box lined with foam. This design's primary purpose is to reduce the risk of theft by disguising the laptop. "Green" laptop cases made of recycled cardboard or carpet strips are also being marketed. Recently, a Japanese company has entered the high end market with a wooden laptop case.

Briefcases

A briefcase is a box-type case that opens into two hinged compartments, much like a small suitcase. Briefcases often comprise a lock, increasing their security over other types of bags. Traditionally, leather or vinyl was stretched over a rigid frame to create a hard-sided briefcase. More recently, briefcases have also been manufactured from plastics, rigid polymers and aluminum, as well as leather.

The traditional hard-sided rectangular briefcase provides protection and security for its contents and is ideal as a carrying case for a laptop. The only real drawback of the hard-sided briefcase is the potential resulting weight of the laptop and the case. As laptops have gotten lighter, the use of impact-resistant briefcases as laptop cases has become feasible. The invention disclosed and claimed herein has its structural and some functional origins in the common briefcase.

Portable Tables and Stands

Collapsible tables and stands that fold into or fit into carrying cases or briefcases are well known. A good example of this is U.S. Pat. No. 4,856,627 to Polatov, which discloses a briefcase that converts into a table. Telescoping legs are stored in compartments on the bottom side of the briefcase and extend to support the briefcase. Inside the cover of the briefcase are planar shelves that can be extended to either side of the briefcase's cover to create a single planar table surface. The briefcase is capable of storing additional materials inside of the case.

There are multiple stands on the market that advertise themselves as portable laptop stands. However, none of them are capable of also carrying a laptop, as in the present invention. It may be possible to fit one of these portable laptop stands into a laptop carrying case, however, those features are not combined into a single unit.

TABLETOTE™ is a commercially available, collapsible table advertised as a laptop stand. The TABLETOTE™ comprises a plastic planar table top with a carrying compartment inside. The carrying compartment is covered by a sliding access panel. Four tubular aluminum legs fit inside of the carrying compartment. The legs can telescope to varying heights. The legs attach to the bottom surface of the table top. The TABLETOTE™ is not a carrying case for it is not capable of transporting anything. Instead it is marketed as a portable laptop stand, workstation or projector stand. The TABLETOTE literature does not disclose a patent number or refer to patent pending status.

U.S. Pat. No. 6,311,944 to McKsymick, et al., discloses another collapsible table, ostensibly for laptops. The McKsymick invention comprises a table top with a hollow underside. Two leg assemblies are attached to the underside of the table top and are capable of folding towards each other to completely fit into the underside of the table top. As with TABLETOTE™, those two devices are arguably portable laptop stands. However, they are not combined with any type of laptop carrying case, and lack many of the features of the present invention. Further, they accomplish the "stand" function in a different manner than the invention disclosed and claimed herein.

A third stand on the market is a simple planar stand with a 90 degree extension at one end. The stand attaches to a standard camera tripod resulting in a device that looks similar to a common collapsible music sheet stand. Again, that device does not fulfill any laptop carrying or transportation function.

BRIEF SUMMARY OF THE INVENTION

The present invention combines the structural features and functionality of a laptop case and a laptop stand into a single, easily portable unit. The exterior housing of the case-stand combination of the present invention resembles a hard-sided briefcase. The case-stand of the present invention also comprises a platform placed inside of the housing and a collapsible laptop stand housed under the platform. The laptop stand is capable of deploying quickly and easily from the bottom of the case-stand. The case-stand combination of the present invention can be placed on any flat surface. The laptop case-stand of the invention can also be placed on a table and opened, so that the laptop can be operated without deploying the stand component.

It is a primary objective of the present invention to combine the functionality of a laptop stand with the convenience and portability of a laptop case-stand, resulting in a single device that can protect and transport a laptop and obviate the need for a table or separate laptop stand.

Another objective of the invention is to provide a portable stand that can be used as a platform for a television, monitor or similar device, including a building computer, medical instruments equipment, travel luggage, compact portable desk and table.

Still another objective of the invention is to provide a portable stand that can be used as a working platform for portable equipment whether it is transported in a case or not.

DETAILED DESCRIPTION OF THE INVENTION

The invention comprises a hard-shelled briefcase-style laptop case that is capable of carrying a laptop and converting into a laptop stand. In order to fulfill its function, the case-stand must be manufactured from a material that is lightweight, impact resistant and visually appealing. These characteristics promote ease of transporting the case-stand and protection for the case-stand's contents from the jostling that commonly occurs during transport.

The invention comprises a hard housing. The housing is preferably manufactured from lightweight metals, such as aluminum and/or lightweight plastics and polymers, such as polypropylene. Multiple materials could also be combined to fulfill the structural and functional requirements of the housing. The exterior surface of the housing must be capable of protecting the case-stand's contents from scratches and impacts. The interior surface of the housing can be lined with foam or other inert, shock-absorbing material to provide additional protection to the contents of the case-stand.

Figure 1:
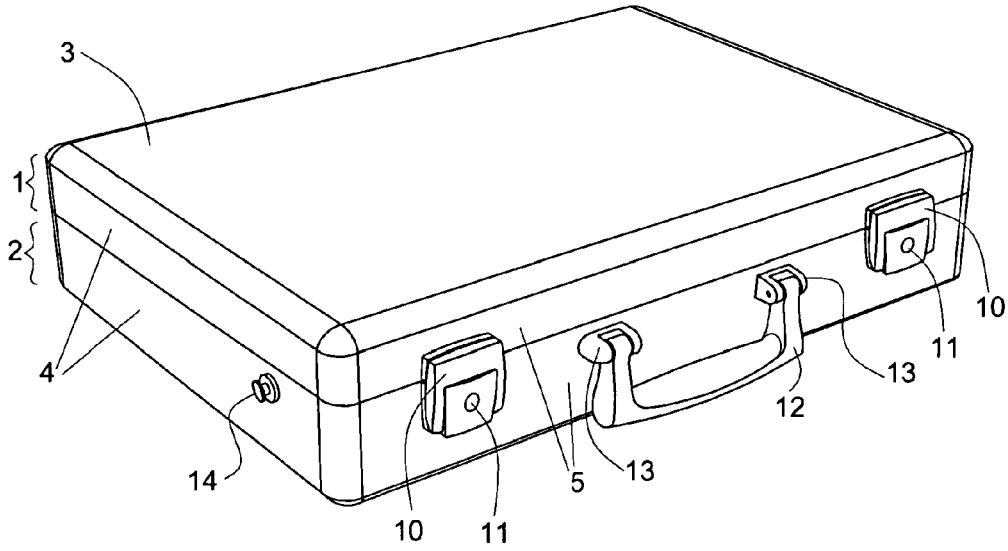
FIG. 1 is a perspective view of the invention with the stand assembly collapsed and the housing closed.
Figure 8:
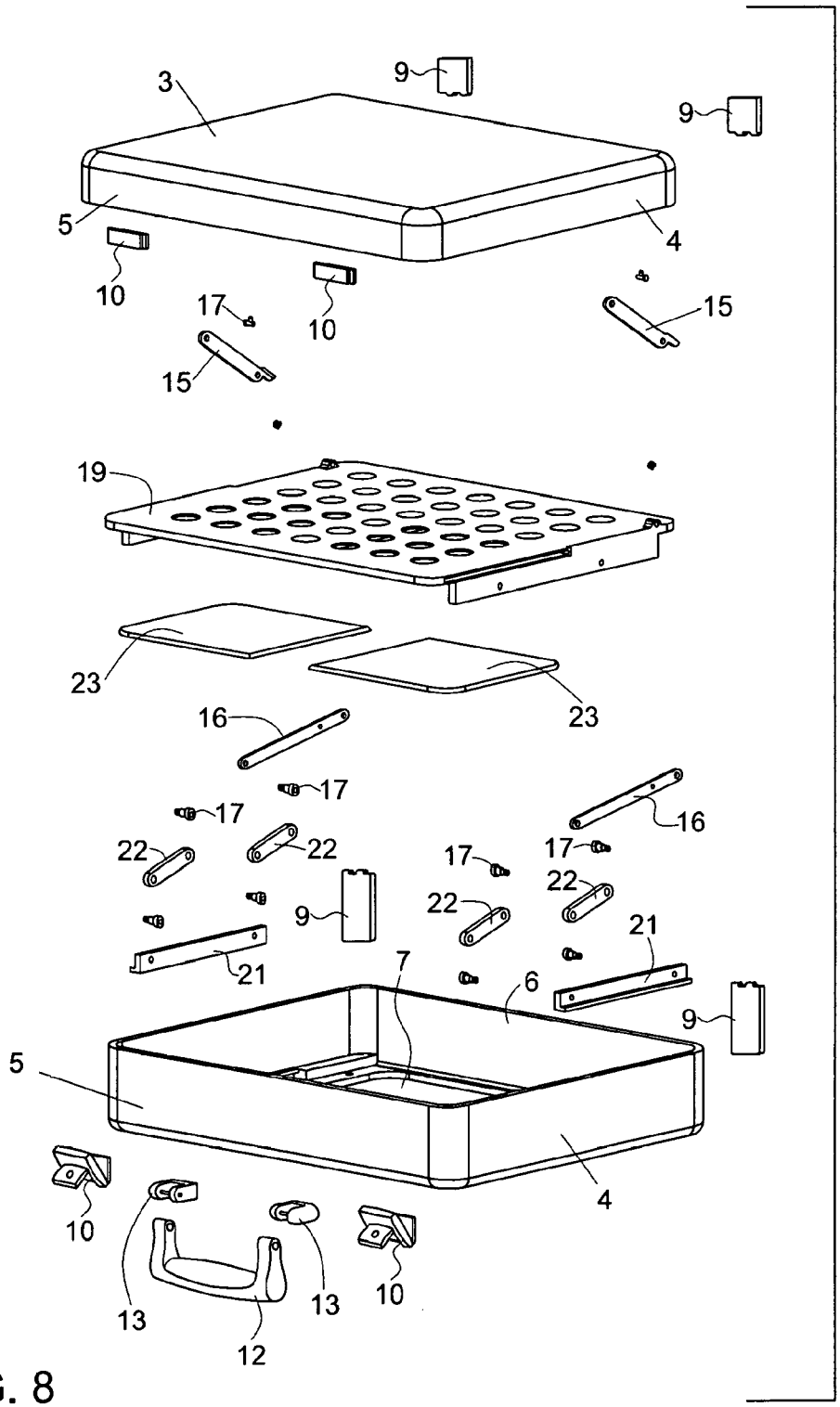
FIG. 8 is an exploded perspective view of the housing and the platform wherein the stand assembly is not depicted.
Figure 11:
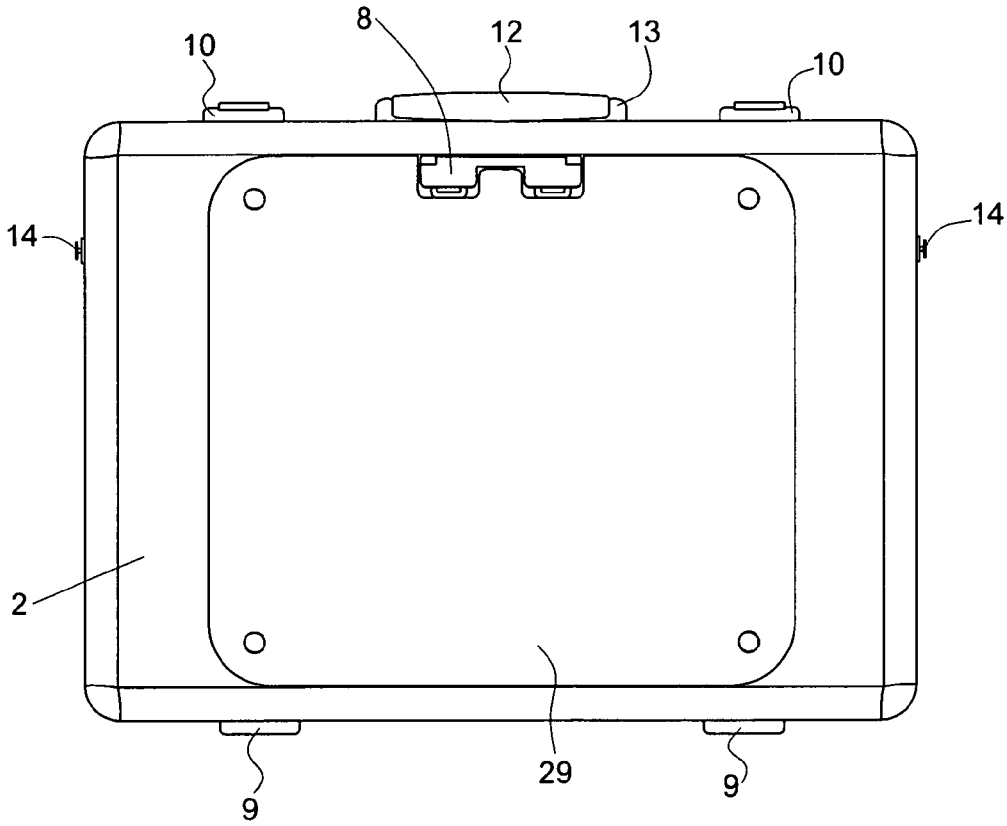
FIG. 11 is an elevational view of the bottom of the housing with the stand assembly collapsed.
Figure 12:
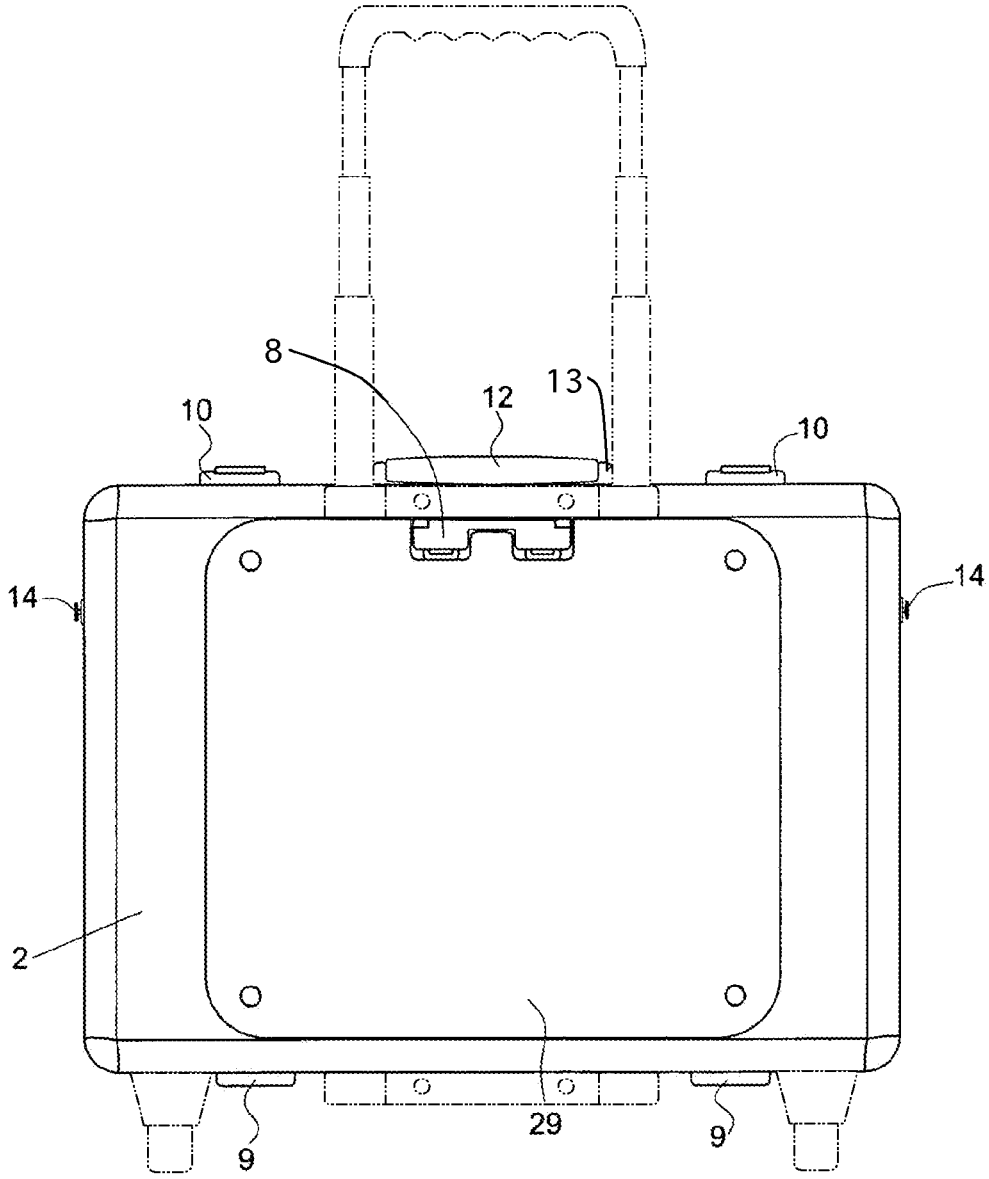
FIG. 12 is an embodiment of the invention with a wheel assembly and extendable handle.

The housing, as pictured in FIG. 1, is essentially a standard hard-sided briefcase, comprising a top compartment (1) and a bottom compartment (2). Each compartment comprises an exterior surface and an interior surface. Each compartment further comprises a generally planar, generally rectangular area (3) and two contiguous sides (4), a front (5) and a back (6). The two rectangular areas (3) are same size, which is larger than the size of the laptop (43) the case is designed to carry. Height of sides (4), front (5) and back (6) is identical in each compartment, but height may vary between the top and bottom compartments. The depths of the compartments may vary in different embodiments, depending on the amount of storage for accessories is desired. The compartments may have rounded corners and edges. The bottom compartment's (2) rectangular area (3) comprises a rectangular opening (7), where the compartment interfaces with the laptop stand assembly (20) of the invention. The rectangular opening is pictured in FIG. 8. The bottom compartment (2) also comprises one or more latches (8), as shown in FIG. 11, located adjacent to the opening in the bottom compartment.

The backs (6) of the two compartments are joined by one or more hinges (9) to form a generally planar surface that allow the case to be rested on the backs when the user sets the case down. The exterior surface of the backs may also comprise one or more stabilizing means (9) to prevent the case from tipping over when rested on the backs. These stabilizing means include multiple raised "feet," a stabilizing ridge around the perimeter of the back, or similar variations found in the art. In FIG. 11, the stabilizing means (9) comprises an integral hinge, combining the two elements.

The exterior surfaces of the fronts (5) comprise a mechanical fastening means (10). The mechanical fastening means comprises a clasp, latch or similar two-part mechanism that has one part on an adjacent location of each compartment's front. The two parts engage to keep the housing firmly closed. The mechanical fastening means may also comprise a locking means (11) or the fronts of the compartments may comprise a locking means that is separate from the latching means. The locking means usually comprises a combination lock or a keyed lock, but could comprise a more sophisticated locking means such as an electronic or biometric lock.

The housing may also comprise a carrying means (12) movably affixed to the outer surface of the compartment via one or more anchoring means (13). The carrying means could be a handle or a strap. The exterior surface of the sides in an area adjacent to the fronts may comprise one or more anchoring means (14), such as a D-ring, capable of engaging a strap or other carrying means.

The interior surface of the compartments comprises two hinges (42), which are movably attached to each side of the interior surface by an attaching means (17), such as a screw or rivet. The hinges attach the top compartment to the bottom compartment. The hinges comprise an upper part (15) and a lower part (16). Each part comprises a top end and a bottom end. The top end of the upper part is attached to the interior of the side of the top compartment. The bottom end of the upper part is movably attached to the top end of the lower part. The bottom end of the lower part is attached to the interior of the side of the bottom compartment. The hinges are capable of controlling how far the top compartment of the housing opens.

Figure 2:
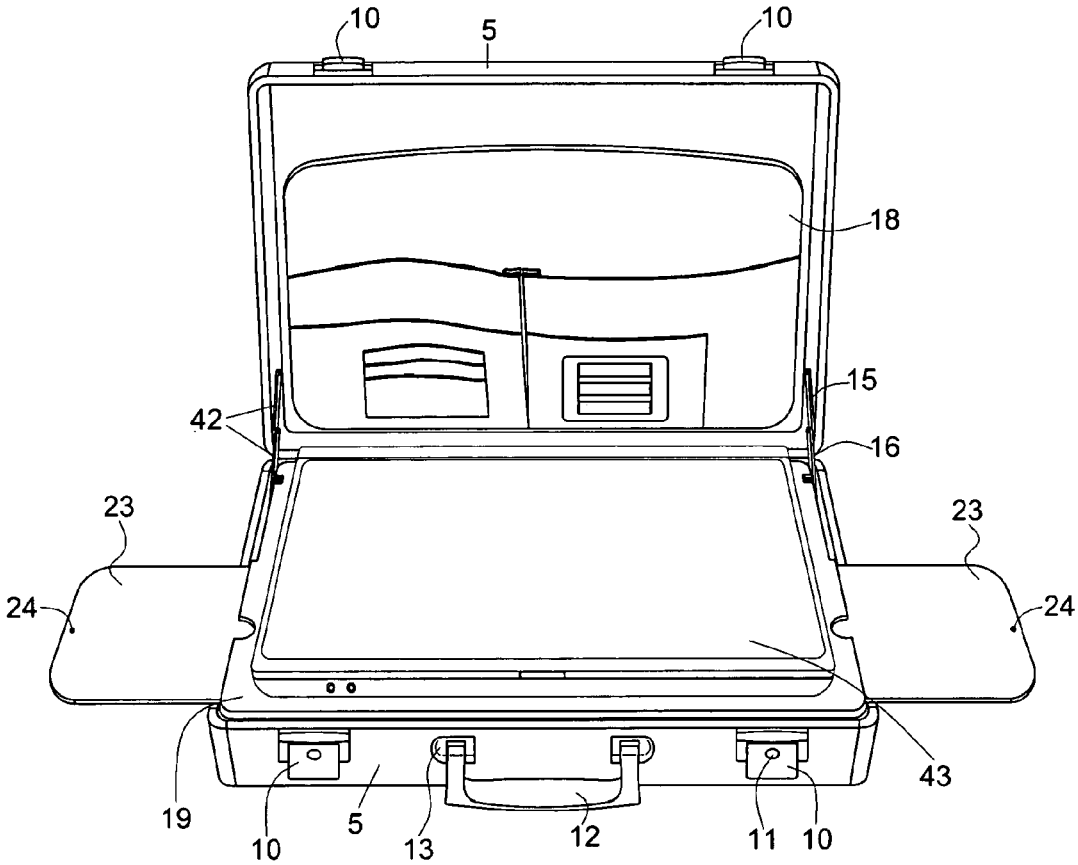
FIG. 2 is a front perspective view of the invention containing a laptop with the housing open, the stand assembly collapsed.
Figure 3:
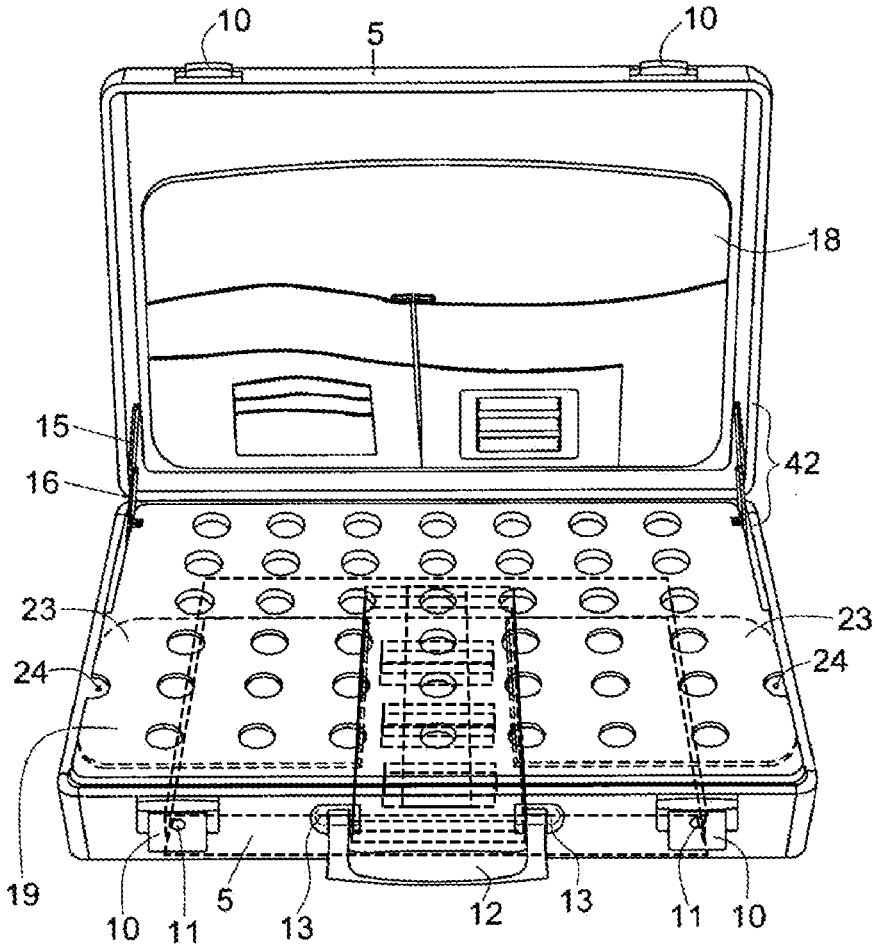
FIG. 3 is a front perspective view of the invention with the housing open and without a laptop, the extensions pushed into the platform and the stand assembly collapsed.
Figure 4:
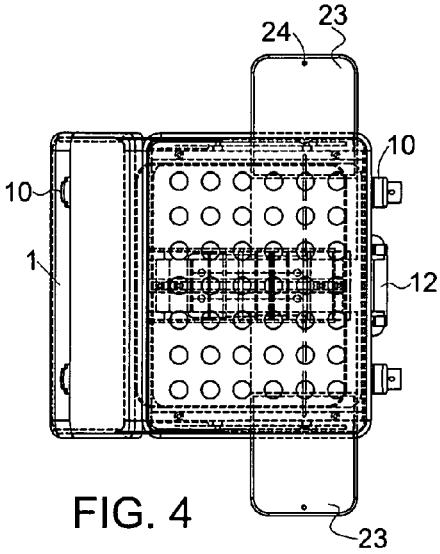
FIG. 4 is a top elevational view of the invention with the stand assembly deployed and the housing open.
Figure 7:
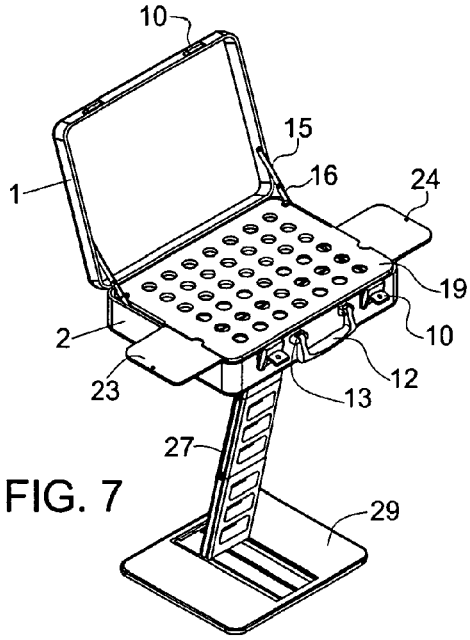
FIG. 7 is a perspective view of the invention with the housing open and the stand assembly deployed.

In the preferred embodiment, the interior surface of the top compartment comprises a padded pouch (18) capable of securing a laptop, as depicted in FIG. 2. The top compartment may also house additional pouches or pockets for laptop accessories, pens, and papers. These pouches and compartments are common elements of laptop cases.

The interior surface of the bottom compartment houses a platform (19) and a stand assembly. The platform is rectangular in shape and is capable of receiving a laptop, as depicted in FIG. 2. The stand assembly is located beneath the platform (19) in the bottom compartment (2) and is capable of deploying through the rectangular opening (7) in the exterior surface of the housing's bottom compartment.

The platform (19) is flat and larger in size than a standard laptop, so that it can function as a place to set the laptop when the laptop is in use, as shown in FIG. 2. In the preferred embodiment, the platform may be perforated to reduce its weight and assist in dissipating heat produced by the laptop. A frame (21) is fixedly attached to the interior surface of the lower compartment's sides. The platform is movably attached to the frame via link arms (22) or similar devices on each side of the lower compartment. The link arms (22) also engage the lower part of the hinge (16) on each side of the lower compartment in such a way that when the hinges (42) fully extend as the housing is opened, the platform (19) is raised so that it is level with or above the lower compartment of the housing. This upward movement allows easy access to a laptop that is placed on the platform without the housing's mechanical fastening means (10) or locking means (11) getting in the way of the user's hands and wrists as the laptop's keyboard is used.

In the preferred embodiment, the platform further comprises multiple small rectangular platform extensions (23) that nest inside of the platform (19). The extensions (23) comprise a grasping means (24), such as a protrusion or recess that can be engaged by the user's fingers to pull the extensions laterally out of the platform. The extensions are secondary platforms that can be used as a mouse pad or temporary storage area for other accessories.

Figure 5:
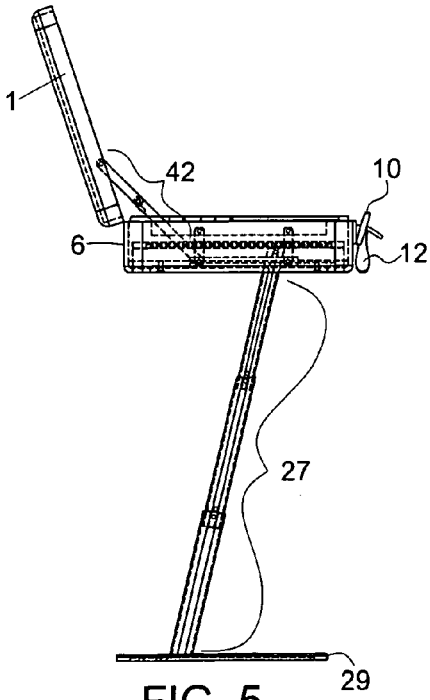
FIG. 5 is a side elevational view of the invention with the housing open and the stand assembly deployed.
Figure 6:
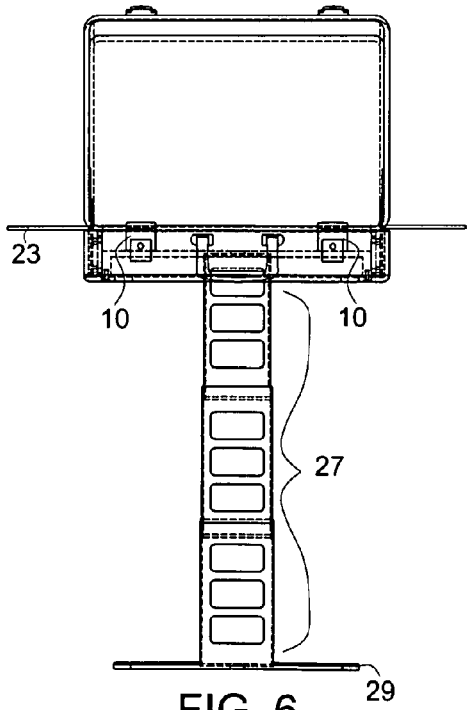
FIG. 6 is a front elevational view of the invention with the housing open and the stand assembly deployed.
Figure 9:
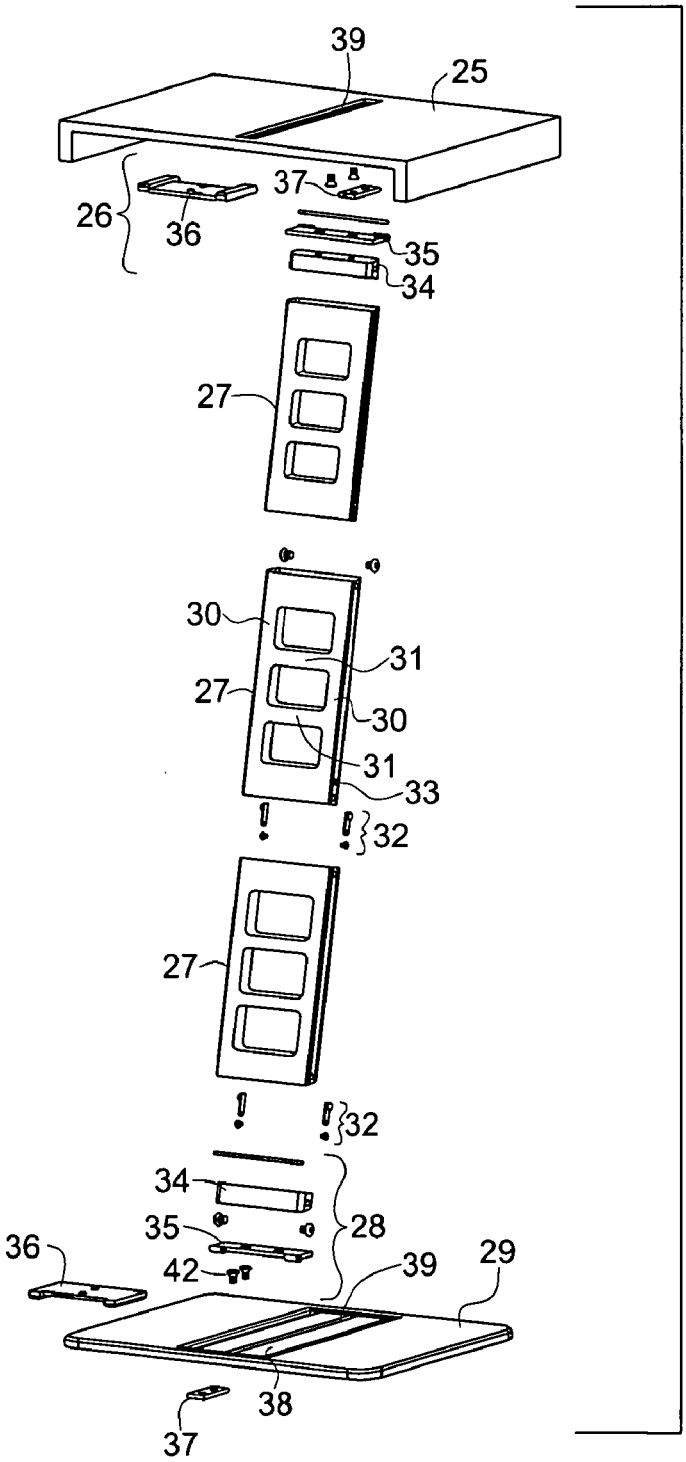
FIG. 9 is an exploded frontal view of the stand assembly of the preferred embodiment of the invention wherein the housing and platform are not depicted.
Figure 10:
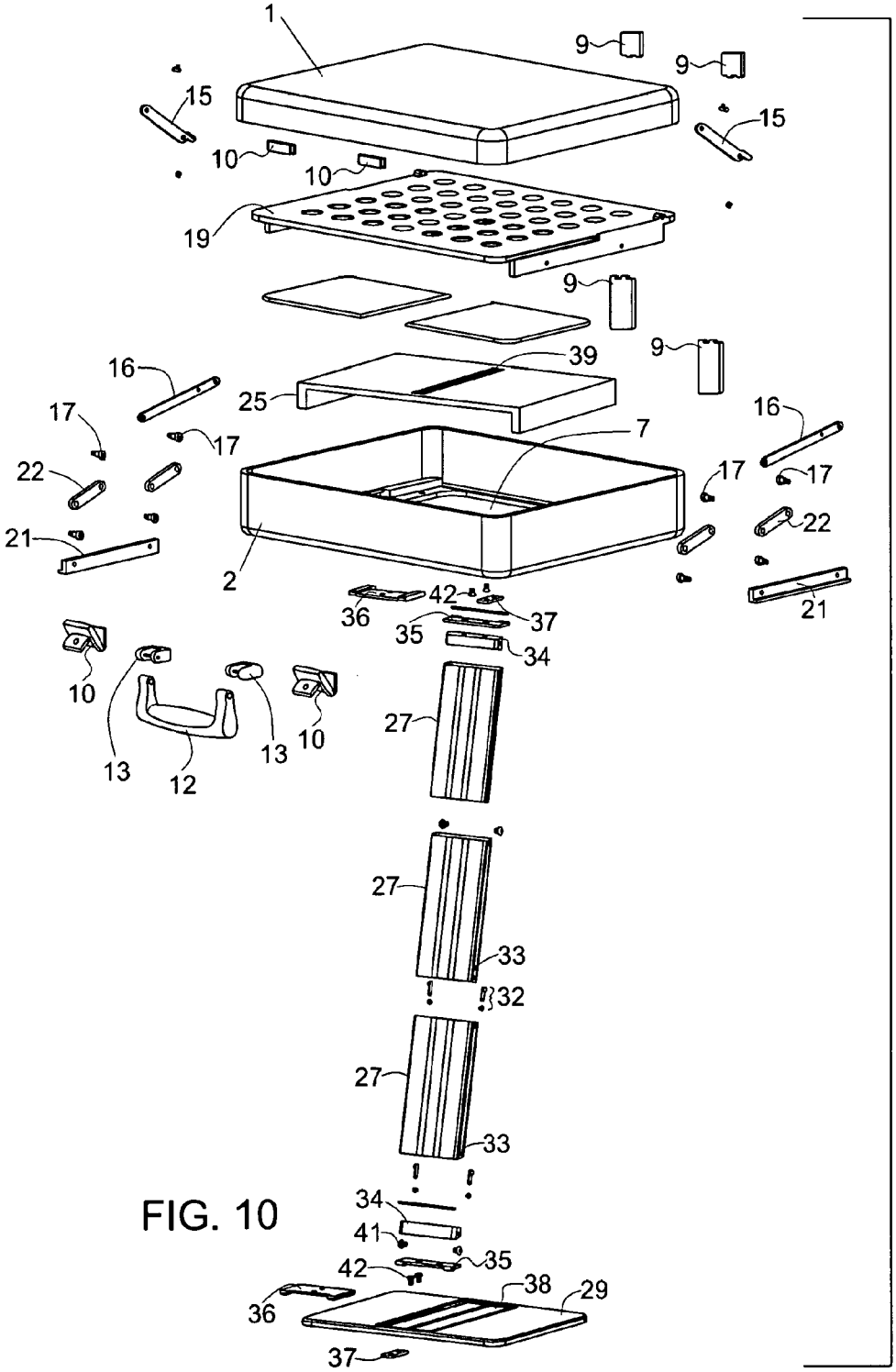
FIG. 10 is an exploded perspective view of the invention.

The interior surface of the bottom compartment (2) of the housing houses a stand assembly. The stand assembly is pictured in FIG. 9. The stand assembly deploys from the rectangular opening (7) in the bottom compartment (2), resulting in the entire housing being raised off the ground to the height the user chooses. The stand assembly comprises a top base (25), an angling means (26), multiple interlocking telescoping risers (27), a second angling means (28) and a bottom base (29). The top and bottom bases are rectangular in shape. The top base (25), risers (27) and bottom base (29) form a "Z"-type shape when the stand assembly is deployed, as depicted in FIG. 5. The stand assembly comprises a minimum of two risers (27), a top riser and a bottom riser. There may be one or more center risers, which are located between the top and bottom risers. In the preferred embodiment of the invention, there is one center riser, for a total of three risers. In the preferred embodiment, the risers (27) have a rectangular ladder-type configuration, wherein each riser comprises two vertical outer beams (30) and multiple horizontal stability supports (31). Both the outer beams (30) and the stability supports (31) can be a regular polygon or circular in cross-section. In an alternative embodiment, as depicted in FIG. 10, the risers may be hollow cuboid tubes.

When deployed, the top (25) and bottom (29) bases are parallel and the risers (27) extend diagonally from one base to the other. When stored inside the housing, the three elements are parallel to one another. The bottom base (29) is large and heavy enough to create a stable base for the invention when the stand assembly is deployed.

In the preferred embodiment, the top base (25) is fixedly attached to the interior surface of the bottom compartment of the housing beneath the platform. The top riser is movably attached to the top base by an angling means (26). The angling means (26) is an interface, such as a bearing or a hinge that can lock into position at the desired angle, between the top base (25) and the top riser. The angling means allows the riser and base to change their position in relation to one another from being "stacked" in a parallel position to being at an acute angle to one-another. The risers (27) are laterally extendable and further comprise a locking means (32) to secure the risers in an extended position. In the preferred embodiment, the locking means is located on the vertical beams (30) and is capable of securing the risers in multiple positions, so that the height of the risers can be adjusted to the needs of the user. In the preferred embodiment, the locking means comprises spring clips and ball detents (33). The bottom riser is movably attached to the bottom base (29) by an angling means (28), which is the mirror image of the angling means (26) between the top riser and top base (25). This allows the stand assembly to be extended and locked into a "Z"-type shape, creating a counter-balance to the weight of the housing and a laptop.

In the preferred embodiment, the angling means comprises a bearing assembly, comprising a riser cap (34), a bearing mount (35), a bearing (36) and a bearing cap (37). The bottom and top base further comprise a recessed area (38) slightly wider than the risers (27) with a slot (39) in the center of the recessed area. The riser cap (34) is fixedly attached to the riser (27). The bearing mount (35) is fixedly attached to the riser cap (34). The bearing mount (35) comprises two or more holes (40) capable of receiving an attaching means (41). The bearing mount (35) is fixedly attached to the bearing (36). Screws, bolts or similar attaching means (41) extend through the slot (39) in the recessed area (38) of the base and interface with the bearing cap (37), which is on the other side of the slot (39) from the rest of the bearing assembly. The bearing assembly is capable of sliding back and forth along the slot (39) in the base when the stand assembly is being deployed by a user.

When the stand assembly is not deployed, the bottom base is flush with the exterior surface of the bottom compartment, creating a contiguous exterior surface, as depicted in FIG. 11. The bottom base is held in place against the bottom compartment by one or more latches (8). In the preferred embodiment, a single latch (8) is movably attached to a recess in the bottom compartment (2) so that it is flush with the exterior surface of the compartment. The latch (8) must be activated by the user to free the bottom base (29) from the housing. When the latch (8) is activated, the bottom base is no longer held against the bottom compartment, and the bottom base (29) and risers (27) can be manipulated to deploy the laptop stand assembly.

In the preferred embodiment, the interior surface of the housing further comprises padding, such as foam rubber, attached to the interior surface to further blunt the force of impacts to the case. In the preferred embodiment, the interior surface of the housing also comprises a securing means affixed to the interior surface to secure a laptop in the housing. The securing means comprises straps that can be attached to one another using Velcro, snaps or their equivalents.

In an alternative embodiment, the housing also comprises a wheel assembly and an extendable handle, so that the user may roll the invention along the ground, rather than carrying it. The wheel assembly comprises a plurality of roller type wheels partially recessed within the housing. The extendable handle is rigid and is recessed within the housing until deployed. Wheel assemblies and extendable handles are common in suitcases and some laptop bags and briefcases.

What is claimed is:

1. A laptop case-stand combination, comprising:

A) a hard-sided briefcase housing made of a lightweight impact resistant material comprising a top compartment and a bottom compartment, said top compartment and said bottom compartment each comprising an interior surface and an exterior surface;

B) a planar platform movably attached to said interior surface of said bottom compartment, said planar platform comprises first and second platform extensions that are nested within said planar platform, said first and second platform extensions slidable laterally from within said planar platform and are approximately parallel to a bottom base of a stand assembly; and C) said stand assembly nesting beneath said planar platform in said bottom compartment, said stand assembly comprising an top base, multiple telescoping risers, and said bottom base, said top base is fixedly attached to said bottom compartment beneath said planar platform, said top base comprising a first interface that can lock into position a predetermined angle defining first angling means, said multiple telescoping risers interlock and comprise a top riser and a bottom riser, said top riser and said bottom riser each comprise first locking means to secure said top riser and said bottom riser in an extended position, said top riser is movably attached to said first interface, said bottom base comprising a second interface that can lock into position at a predetermined angle defining second angling means, said second interface is attached to said bottom riser, said upper base, said top riser and said bottom riser, and said lower base form a "Z"-type shape when in a deployed configuration.

2. The laptop case-stand combination set for in claim 1, further comprising at least one center riser located between said top riser and said bottom riser.

3. The laptop case-stand combination set for in claim 2, further characterized in that when in said deployed configuration, said top base and said bottom base are parallel with respect to each other, and said top riser, said bottom riser, and said at least one center riser are aligned and extend diagonally from said top base to said bottom base.

4. The laptop case-stand combination set for in claim 3, further characterized in that when nested inside said hard-sided briefcase housing, said top riser, said bottom riser, and said at least one center riser are all parallel to one another.

5. The laptop case-stand combination set for in claim 4, further characterized in that said at least one center riser comprises second locking means for securing between said top riser and said bottom riser.

6. The laptop case-stand combination set for in claim 5, further characterized in that said first and second locking means together comprise spring clips and ball detents, said ball detents corresponding to respective said spring clips.

7. The laptop case-stand combination set for in claim 6, further characterized in that said hard-sided briefcase housing comprises a wheel assembly and extendable handle.

8. The laptop case-stand combination set for in claim 7, further characterized in that said at least one center riser, said top riser, and said bottom riser have a rectangular ladder-type configuration.

9. The laptop case-stand combination set for in claim 8, further characterized in that said at least one center riser, said top riser, and said bottom riser each comprise two vertical outer beams and multiple horizontal stability supports.

10. The laptop case-stand combination set for in claim 9, further characterized in that said two vertical outer beams and said multiple horizontal stability supports are hollow cuboid tubes.

11. The laptop case-stand combination set for in claim 9, further characterized in that said two vertical outer beams and said multiple horizontal stability supports are polygon or circular in cross-section.

12. A laptop case-stand in combination with a laptop computer, comprising:

A) a hard-sided briefcase housing made of a lightweight impact resistant material comprising a top compartment and a bottom compartment, said top compartment and said bottom compartment each comprising an interior surface and an exterior surface;

B) a planar platform movably attached to said interior surface of said bottom compartment, said planar platform comprises first and second platform extensions that are nested within said planar platform, said first and second platform extensions slidable laterally from within said planar platform and are approximately parallel to a bottom base of a stand assembly; and C) said stand assembly nesting beneath said planar platform in said bottom compartment, said stand assembly comprising an top base, multiple telescoping risers, and said bottom base, said top base is fixedly attached to said bottom compartment beneath said planar platform, said top base comprising a first interface that can lock into position a predetermined angle defining first angling means, said multiple telescoping risers interlock and comprise a top riser and a bottom riser, said top riser and said bottom riser each comprise first locking means to secure said top riser and said bottom riser in an extended position, said top riser is movably attached to said first interface, said bottom base comprising a second interface that can lock into position at a predetermined angle defining second angling means, said second interface is attached to said bottom riser, said multiple telescoping risers also comprise at least one center riser located between said top riser and said bottom riser, said top base, said top riser and said bottom riser, and said bottom base form a "Z"-type shape when in a deployed configuration, and when in said deployed configuration, said top base and said bottom base are parallel with respect to each other, and said top riser, said bottom riser, and said at least one center riser are aligned and extend diagonally from said top base to said bottom base.

13. The laptop case-stand combination set for in claim 12, further characterized in that when nested inside said hard-sided briefcase housing, said top riser, said bottom riser, and said at least one center riser are all parallel to one another.

14. The laptop case-stand combination set for in claim 13, further characterized in that said at least one center riser comprises second locking means for securing between said top riser and said bottom riser.

15. The laptop case-stand combination set for in claim 14, further characterized in that said first and second locking means together comprise spring clips and ball detents, said ball detents corresponding to respective said spring clips.

16. The laptop case-stand combination set for in claim 15, further characterized in that said hard-sided briefcase housing comprises a wheel assembly and extendable handle.

17. The laptop case-stand combination set for in claim 16, further characterized in that said at least one center riser, said top riser, and said bottom riser have a rectangular ladder-type configuration.

18. The laptop case-stand combination set for in claim 17, further characterized in that said at least one center riser, said top riser, and said bottom riser each comprise two vertical outer beams and multiple horizontal stability supports.

19. The laptop case-stand combination set for in claim 18, further characterized in that said two vertical outer beams and said multiple horizontal stability supports are hollow cuboid tubes.

20. The laptop case-stand combination set for in claim 18, further characterized in that said two vertical outer beams and said multiple horizontal stability supports are polygon or circular in cross-section.

* * * * *